US011059147B2

(12) United States Patent
Mejean et al.

(10) Patent No.: US 11,059,147 B2
(45) Date of Patent: Jul. 13, 2021

(54) ABRASIVE ARTICLE INCLUDING A COATING

(71) Applicants: SAINT-GOBAIN ABRASIVES, INC., Worcester, MA (US); SAINT-GOBAIN ABRASIFS, Conflans-Sainte-Honorine (FR)

(72) Inventors: Cecile O. Mejean, Acton, MA (US); Charles J. Gasdaska, Shrewsbury, MA (US); Lucie Fraichard, Boston, MA (US)

(73) Assignee: SAINT-GOBAIN ABRASIVES, INC./SAINT-GOBAIN ABRASIFS, Worcester, MA (US)

( * ) Notice: Subject to any disclaimer, the term of this patent is extended or adjusted under 35 U.S.C. 154(b) by 0 days.

(21) Appl. No.: 16/370,529

(22) Filed: Mar. 29, 2019

(65) Prior Publication Data

US 2019/0299363 A1 Oct. 3, 2019

Related U.S. Application Data

(60) Provisional application No. 62/650,998, filed on Mar. 30, 2018.

(51) Int. Cl.

| | |
|---|---|
| ***B24D 3/28*** | (2006.01) |
| ***B24D 11/02*** | (2006.01) |
| ***B24D 11/00*** | (2006.01) |
| ***B24D 3/00*** | (2006.01) |

(52) U.S. Cl.

CPC ..... *B24D 3/28* (2013.01); *B24D 3/007* (2013.01); *B24D 11/001* (2013.01); *B24D 11/02* (2013.01)

(58) Field of Classification Search

CPC ..... B24D 3/28; B24D 3/007; B24D 11/001; B24D 11/02

See application file for complete search history.

(56) References Cited

U.S. PATENT DOCUMENTS

| | | | |
|---|---|---|---|
| 4,960,050 | A | 10/1990 | Hatch |
| 5,049,164 | A | 9/1991 | Horton |
| 5,154,978 | A | 10/1992 | Nakayama |
| 5,534,068 | A | 7/1996 | Beach |
| 5,707,409 | A | 1/1998 | Martin |
| 5,849,962 | A | 12/1998 | Dolbier |
| 6,030,381 | A | 2/2000 | Jones |

(Continued)

FOREIGN PATENT DOCUMENTS

| | | |
|---|---|---|
| EP | 1075354 B1 | 12/2004 |
| KR | 1020160014977 | 2/2016 |

(Continued)

OTHER PUBLICATIONS

International Search Report dated Jul. 9, 2019, with regard to International application No. PCT/US2019/024984.

*Primary Examiner* — Pegah Parvini

(74) *Attorney, Agent, or Firm* — Abel Schillinger, LLP; Joseph P. Sullivan

(57) ABSTRACT

An abrasive article can include a substrate, abrasive particles coupled by a bond material to the substrate, and a coating overlying at least partially the exterior surface of the bond material. The coating can be a poly(p-xylylene) polymer applied via vapor deposition and may provide enhanced strength to the bond material and extended life time to the abrasive article.

20 Claims, 7 Drawing Sheets

(56) References Cited

U.S. PATENT DOCUMENTS

| | | | | |
|---|---|---|---|---|
| 6,528,153 | B1 | 3/2003 | Benzing | |
| 8,721,395 | B2 | 5/2014 | Wu | |
| 2007/0184654 | A1 | 8/2007 | Akram | |
| 2008/0233850 | A1* | 9/2008 | Woo | B24B 7/00 451/526 |
| 2009/0042166 | A1* | 2/2009 | Craig | A61C 3/06 433/166 |
| 2010/0047467 | A1 | 2/2010 | Nesbitt | |
| 2010/0330886 | A1* | 12/2010 | Wu | B24B 53/12 451/56 |
| 2011/0308371 | A1* | 12/2011 | Morita | B24D 3/08 83/830 |
| 2012/0122377 | A1 | 5/2012 | Wu | |
| 2013/0216599 | A1 | 8/2013 | Kumar | |
| 2015/0001700 | A1* | 1/2015 | Hartung | H01L 23/24 257/698 |
| 2017/0008153 | A1 | 1/2017 | Sivasubramanian | |

FOREIGN PATENT DOCUMENTS

| | | | |
|---|---|---|---|
| KR | 101690053 | B1 | 12/2016 |
| WO | 9956913 | A | 11/1999 |

* cited by examiner

Parylene N

Parylene C

Parylene D

Parylene HT

ABRASIVE ARTICLE INCLUDING A COATING

CROSS-REFERENCE TO RELATED APPLICATION(S)

The present application claims priority under 35 U.S.C. § 119(e) to U.S. Provisional Patent Application No. 62/650,998, filed Mar. 30, 2018, entitled "ABRASIVE ARTICLE INCLUDING A COATING," naming as inventors Cecile O. MEJEAN, et al., which application is assigned to the current assignee hereof and is incorporated by reference herein in its entirety.

BACKGROUND

Field of the Disclosure

The following is directed to an abrasive article, and particularly, to an abrasive article including a coating comprising a poly(p-xylylene) polymer.

Description of the Related Art

Fixed abrasive articles can be used in various material removal operations. The industry continues to demand improved fixed abrasive articles.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
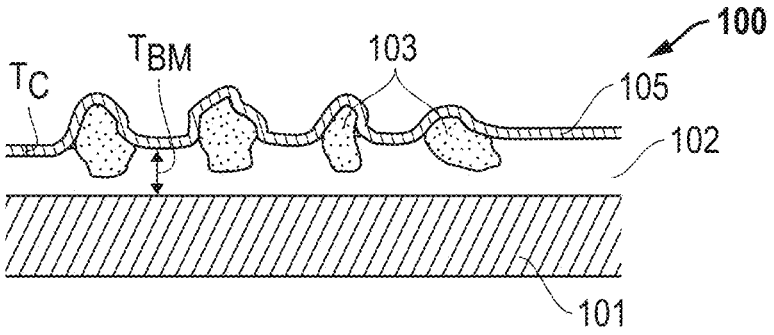
FIG. 1 includes a cross-sectional illustration of an abrasive article according to one embodiment.

The following description in combination with the figures is provided to assist in understanding the teachings provided herein. The following disclosure will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

Embodiments disclosed herein are directed to an abrasive article including a substrate and abrasive particles coupled to the substrate by a bond material. The bond material can further include a coating. The coating can include a polymeric material and can cover at least a portion of the bond material, at least a portion of the abrasive particles or at least a portion of the bond material and the abrasive particles. The coating may provide the advantage of increasing the strength of the bond material and protecting the bond material from corrosion and deterioration when exposed to coolant fluids, specifically water-based coolants.

The bonded abrasive article described in embodiments herein can be suitable for various material removal operations, particularly those suitable for single-layered abrasive articles, such as coated abrasives and single layer metal bonded abrasive tools. Such abrasive articles may be distinct from bonded abrasive articles, wherein bonded abrasive articles include a three-dimensional matrix of bond material including abrasive particles contained therein. By contrast, single-layered abrasive articles typically include a single layer of abrasive particles attached to a substrate by at least one bond material.

FIG. 1 illustrates an abrasive article (100) according to one embodiment of the present disclosure, including a substrate (101) and abrasive particles (103) coupled to the substrate (101) by a bond material (102). The abrasive article (100) can further contain a coating (105) which can overly at least a portion of the bond material. The applied coating (105) may be suitable to improve the performance of the abrasive article, including, but not limited to, providing suitable protection of the bond material (102) from damaging influence of a coolant.

The present disclosure further relates to a method of making the abrasive article. In one embodiment, an uncoated abrasive article may be provided comprising a substrate having abrasive particles coupled to the substrate by a bond material. Various suitable methods may be used to form the abrasive article depending upon the composition of the substrate, bond material, and abrasive particles. For example, the abrasive particles may be adhered to the substrate via a bond material that can be formed using one or more processes selected from the group consisting of heating, cooling, curing, depositing, brazing, plating (e.g., electroplating or electroless plating), irradiating, spraying, drying, or any combination thereof.

The coating may be applied using various depositing processes, including but not limited to, a vapor deposition process.

The coating of the present disclosure can include a substituted or unsubstituted poly(p-xylylene) polymer, also called hereafter a parylene. In aspects, the poly(p-xylylene) polymer can be halogenated and include fluorine, chlorine, bromine, or any combination thereof. In further aspects, the poly(p-xylylene) polymer can include alkyl groups or alkoxy groups. In yet further aspects, the poly(p-xylylene) polymer can be a linear polymer, a cross-polymer, or a copolymer. In a particular embodiment, the coating can include a fluorinated poly(p-xylylene).

Figure 8:
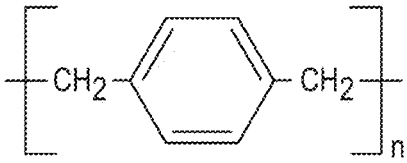
FIG. 8 includes chemical structure formulas of polymer materials included in the coating according to embodiments.
Figure 8:
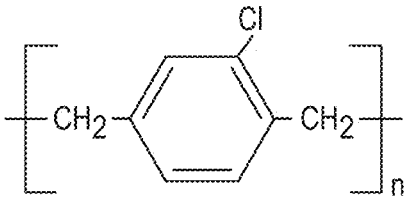
Figure 8:
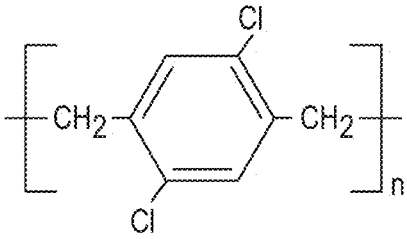
Figure 8:
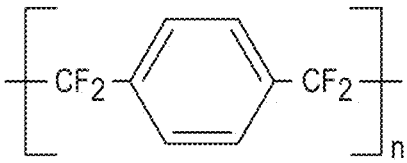

In a specific embodiment, the fluorinated poly(p-xylylene) can have a structure as illustrated in FIG. 8, called parylene HT. In other specific embodiments, as also illustrated in FIG. 8, the poly(p-xylylene) polymer can be chlorinated and have the structure shown for parylene C or parylene D. In another certain embodiment, unsubstituted poly(p-xylylene) may be used for the coating, as shown for structure parylene N in FIG. 8. In a particular embodiment, the coating can consist essentially of parylene HT. In another particular embodiment, the coating can only contain parylene HT except for unavoidable impurities. Unavoidable impurities should be understood as being impurities in an amount not greater than 0.1 vol % based on the total volume of the coating. As used herein, if referring to "the coating" is intended to mean the parylene coating overlying the bond material and the abrasive particles. Any other coatings of the abrasive article, e.g., a multi-layer bond structure and the coating layers therein (e.g., a make coat and/or a size coat), will be clearly described otherwise by name and not just called "coating."

In a further embodiment, the coating of the present disclosure can have a melting temperature of at least 250° C., such as at least 270° C., or at least 290° C., or at least 310° C., or at least 330° C., or at least 350° C., or at least 380° C., or at least 400° C., or at least 420° C., or at least 440° C., or at least 460° C., or at least 480° C., or at least 500° C. In another embodiment, the coating can have a melting point not greater than 600° C., or not greater than 580° C., or not greater than 550° C.; or not greater than 530° C., or not greater than 510° C., or not greater than 500° C., or not greater than not 460° C., or not greater than 420° C., or not greater than 390° C. The melting temperature of the coating can be a value between any of the minimum and maximum values note above, such as from 250° C. to 600° C., or from 290° C. to 530° C., or from 350° C. to 510° C., or from 380° C. to 500° C.

In one embodiment, an average thickness of the coating can be at least 0.1 microns, or at least 0.3 microns, or at least 0.5 microns, or at least 1 micron, or at least 2 microns, or at least 3 microns, or at least 5 microns, or at least 7 microns, or a least 10 microns. In another embodiment, an average thickness of the coating may be not greater than 500 microns, or not greater than 300 microns, or not greater than 200 microns, or not greater than 100 microns, or not greater than 75 microns, or not greater than 50 microns, or not greater than 25 microns, or not greater than 10 microns, or not greater than 7 microns, or not greater than 5 microns. The thickness of the coating can be a value between any of the minimum and maximum values noted above, such as within a range including at least 0.1 microns to not greater than 500 microns, at least 1 micron to not greater than 100 microns, or at least from 2 microns to not greater than 20 microns, or at least from 3 microns to not greater than 10 microns. In a particularly preferred embodiment, the thickness of the coating is within a range of 1 micron to 10 microns.

The bond material of the abrasive article of the present disclosure may have a particular bond chemistry that may facilitate improved manufacturing and performance of the abrasive article of the present disclosure. The bond material can be an inorganic material, an organic material, or a combination thereof. The bond material can have a certain porosity or be free porosity. The bond material may have a limited content of porosity, such as small pores at the surface of the bond material. In at least one embodiment, the bond material can be free of porosity.

In one embodiment, the bond material can be an inorganic material, such as a metal, a metal alloy, a ceramic, a glass, a ceramic, a cermet, or any combination thereof. The bond material may have at least one of a monocrystalline phase, a polycrystalline phase, amorphous phase, or any combination thereof. In yet a further aspect, the bond material can include an oxide, a boride, a nitride, a carbide, or any combination thereof.

In a particular embodiment, the metal contained in the bond material can be nickel, lead, silver, copper, zinc, tin, titanium, molybdenum, chromium, iron, manganese, cobalt, niobium, tantalum, tungsten, palladium, platinum, gold, ruthenium, or any combination thereof. In a particular embodiment, the bond material can consist essentially of nickel. In a further embodiment, the bond material can consist essentially of nickel, such that the bond material include only nickel and some unavoidable impurities, wherein unavoidable impurities may be not greater than 0.1 vol % of the total nickel material. In another certain embodiment, the bond material can include a braze. In yet a further certain embodiment, the bond material can be a solder. The solder can have a melting temperature of at least 100° C. and not greater than 450° C. In another aspect, the bond material can include a metal alloy containing at least one transition metal element. The bond material may consist essentially of any of the foregoing inorganic materials.

In another embodiment, the bond material may be an organic material, such as a natural material, a synthetic material, a polymer, a resin, an epoxy, a thermoset, a thermoplastic, an elastomer, or any combination thereof. In a certain embodiment, the organic material can include a phenolic resin, an epoxy resin, a polyester resin, a polyurethane, a polyester, a polyimide, a polybenzimidazole, an aromatic polyamide, a modified phenolic resin (such as: epoxy modified and rubber modified resin, or phenolic resin blended with plasticizers) or any combination thereof. In a particular embodiment, the organic material contained in the bond material can include a phenolic resin. Exemplary phenolic resins can be resole resin or novolac resin. The bond material may consist essentially of any of the foregoing organic materials.

The bond material can overly the substrate and abrasive particles in form of a layer. The layer formed by the bond material can be a continuous layer or a discontinuous layer. In a particular embodiment, the bond material can be a continuous layer having a substantially uniform thickness. In another embodiment, the bond material can be a discontinuous layer having bond regions separated by gap regions, wherein the gap regions define portions of the abrasive article free of the bond material. In one aspect, gap regions free of bond material can be surface regions of the substrate (see, for example, FIG. 5).

In one embodiment, the bond material can be a plurality of layers, including a first layer and a second layer overlying the first layer. For example, the bond material may include a plurality of films, wherein each of the films can be formed by the same or different processes as disclosed herein. Each of the films can include one or more of the organic and/or inorganic materials described herein as suitable for use as the bond material.

The bond material can couple the abrasive particles to the substrate. In one embodiment, the abrasive particles can be arranged within the bond material such that not more than one abrasive particle may be contained in a thickness direction of the bond material, which is generally understood to be a single-layer fixed abrasive article. In a particular embodiment, as illustrated, for example, in FIG. 1, a certain portion of the abrasive particles (103) can extend above the exterior surface of the bond material (102) and may be not covered with bond material. In yet other embodiment, more than a single layer of abrasive particles can be contained within the bond material and only the abrasive particles close to the exterior surface of the bond material may partially stick out from the bond material.

In a certain particular embodiment, the abrasive article of the present disclosure can be a metal single layer abrasive article. As used herein, a metal single layer abrasive article is intended to relate to an abrasive article wherein a single layer of abrasive particles are coupled to the substrate by a bond material, and the bond material consists essentially of a metal or metal alloy.

The material of the abrasive particles can include an oxide, a carbide, a nitride, a boride, an oxynitride, an oxyboride, diamond, or any combination thereof. In a certain aspect, the abrasive particles can include a superabrasive material, for example, diamond or cubic boron nitride. In a particular embodiment, the abrasive particles can consist essentially of diamond. In another aspect, the abrasive particles may have a Vickers hardness of at least about 10 GPa.

In a further aspect, the abrasive particles can include a first type of abrasive particle and a second type of abrasive particle, wherein the first type of abrasive particle and second type of abrasive particle can be different from each other based on at least one particle characteristics selected from the group consisting of hardness, friability, toughness, particle shape, crystalline structure, average particle size, composition, particle coating, grit size distribution, or any combination thereof.

In one embodiment, the average particles size of the abrasive particles (D50) can be at least 0.1 microns or at least 0.5 microns or at least 1 micron or at least 2 microns or at least 5 microns or at least 8 microns. In another embodiment, the average particle size of the abrasive particles may be not greater than 5000 microns or not greater than 3000 microns or not greater than 2000 microns or not greater than 1500 microns or not greater than 1000 microns or not greater than 900 microns or not greater than 800 microns or not greater than 500 microns or not greater than 300 microns. The average particles size of the abrasive particles can be a value within any of the minimum and maximum values noted above, such as within a range including at least 0.1 micron to not greater than 5000 microns, or at least 10 microns to not greater than 3000 microns, or at least 30 microns to not greater than 1000 microns.

In one embodiment, the abrasive particles can have an average particle size (D50) greater than an average thickness $T_{BM}$ of the bond material in regions wherein no abrasive particles are contained in a thickness direction of the bond material (see, e.g., FIG. 1). In one aspect, the ratio of the average thickness of the bond material $T_{BM}$ to the average particle size of the abrasive particles ($T_{BM}$/D50) can be not greater than 1, such as not greater than 0.9, or not greater than 0.8, or not greater than 0.7, or not greater than 0.6, or not greater than 0.5, or not greater than 0.4, or not greater than 0.3, or not greater than 0.2, or not greater than 0.1. In another aspect, the ratio ($T_{BM}$/D50) can be at least 0.1, such as at least 0.2, or at least 0.3, or at least 0.4, or at least 0.5, or at least 0.6, or at least 0.7, or at least 0.8, or at least 0.9. The ratio ($T_{BM}$/D50) can be a value between any of the maximum and minimum values noted above, such as within a range including not greater than 1 to at least 0.1, not greater than 0.7 to at least 0.2, or not greater than 0.5 to at least 0.1.

The substrate of the abrasive article of the present disclosure can comprise an elongated member having an aspect ratio of length:width of at least about 10:1. In one aspect, the substrate can have an average length of at least 50 m, such as at least 70 m, or at least 100 m. In a particular aspect, the substrate can be a wire. In another particular aspect, the substrate can be a plurality of filaments braided together. Such as substrate may be suitable for forming single-layered abrasive wires.

In another particular embodiment, the substrate can have a round shape, e.g., a disc as the support structure of a single layer abrasive wheel.

In another embodiment, the abrasive article of the present disclosure can be a complex shaped tool based on a substrate having a complex shape. As used herein, a complex shaped substrate can have surfaces with a non-monotonic curvature, more specifically a combination of different curvatures, such as a combination of convex and concave curvatures. The substrate (sometimes also called backing herein) can be an organic material, an inorganic material, or a combination thereof. Particularly suitable organic substrate materials can include polymers, such as polyester, polyurethane, polypropylene, and/or polyimide, for example KAPTON from DuPont, and paper. Some suitable inorganic materials can include metals, metal alloys, and particularly, foils of copper, aluminum, steel, or any combination thereof. In certain instances, the substrate can include a woven material or a non-woven material. The substrate can include one or more additives selected from the group of catalysts, coupling agents, curants, anti-static agents, suspending agents, anti-loading agents, lubricants, wetting agents, dyes, fillers, viscosity modifiers, dispersants, defoamers, and grinding agents. Such substrate materials may be suitable for use in coated abrasive articles.

The coating of the abrasive article of the present disclosure can at least partially overly the exterior surface of the bond material and thereby may strengthen and protecting the bond material and its ability to hold the abrasive particles.

In one embodiment, as illustrated in FIG. 1, the coating (105) can be in direct contact with the bond material and may further overly a majority of the exterior surfaces of the abrasive particles (103) extending above the bond material (102).

Figure 2:
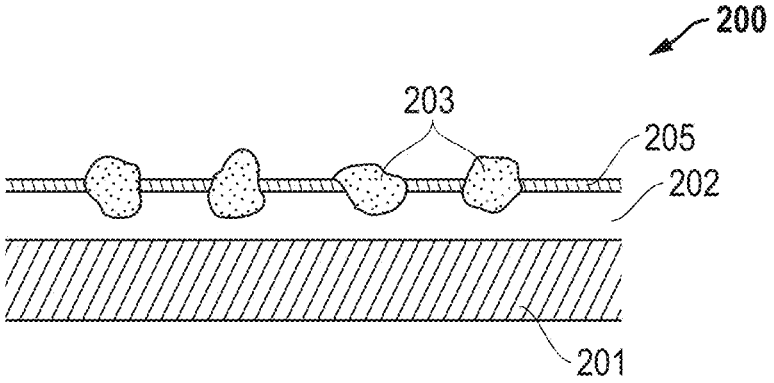
FIG. 2 includes a cross-sectional illustration of an abrasive article according to one embodiment.

In another embodiment, the coating (205) can be in direct contact with the bond material (202) overlying the substrate (201), and a majority of the exterior surfaces of the abrasive particles (203) extending above the bond material (202) are free of the coating (205), as illustrated in FIG. 2.

Figure 3:
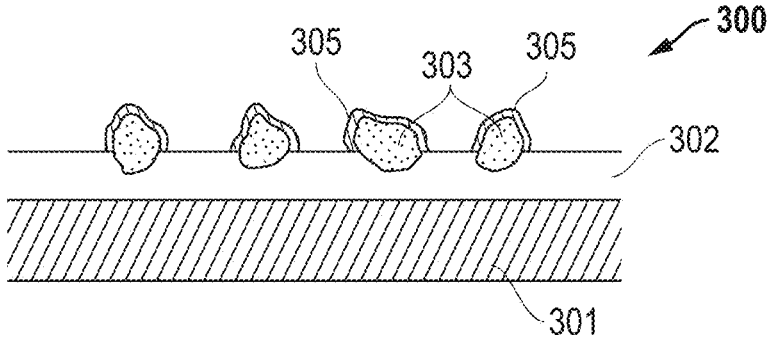
FIG. 3 includes a cross-sectional illustration of an abrasive article according to one embodiment.

In a further embodiment, the coating (305) can be in direct contact with the abrasive particles (303) and a majority of an exterior surface of the bond material (302) overlying the substrate (301) may be free of the coating (305), see FIG. 3.

Figure 4:
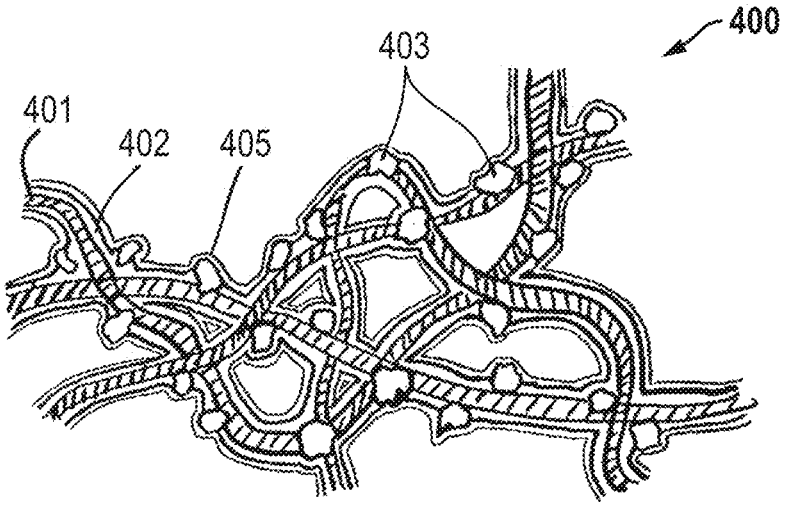
FIG. 4 includes an illustration of a portion of an abrasive article according to one embodiment.

In yet another embodiment, the substrate (401) of an abrasive article (400) can be non-woven fibers twisted on each other containing abrasive particles (403) coupled to the fibers by a bond material (402), wherein the bond material (402) and the extending abrasive particles (403) are at least partially coated by the coating (405) of the present disclosure, as illustrated in FIG. 4.

Figure 5:
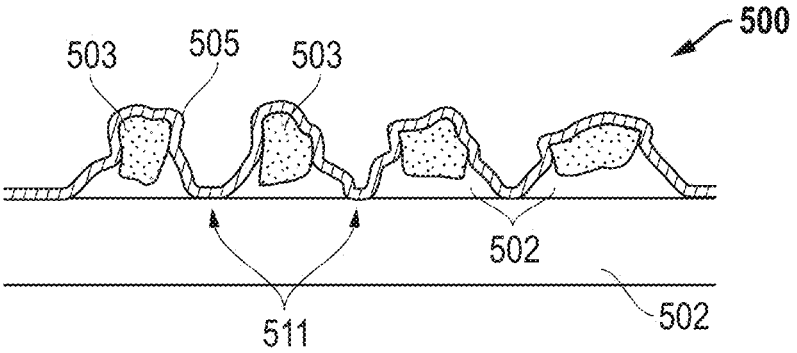
FIG. 5 includes a cross-sectional illustration of an abrasive article according to one embodiment.

In a further particular embodiment, the coating can be a conformal coating extending over the abrasive particles and the bond material. In a certain aspect, the coating can define the exterior surface of the abrasive article. FIG. 5 illustrates an embodiment of a conformal coating (505), wherein the bond material (502) can be a discontinuous layer, and the coating (505) may directly overly portions of the substrate (501), the extending portions of the abrasive particles (503) and the exterior surface of the bond material (502).

In one embodiment, the coating can have an average thickness ($T_C$) and the bond material may have an average thickness ($T_{BM}$) in areas where no abrasive particles are included in a thickness direction of the bond material layer, wherein $T_C$ is lower than $T_{BM}$. In one aspect, the ratio of ($T_C/T_{BM}$) may be not greater than 0.99, such as not greater than 0.9, or not greater than 0.8, or not greater than 0.7, or not greater than 0.6, or not greater than 0.5, or not greater than 0.4, or not greater than 0.3, or not greater than 0.2, or not greater than 0.1, or not greater than 0.08, or not greater than 0.05, or not greater than 0.03. In another aspect, the ratio of ($T_C/T_{BM}$) can be at least 0.001, such as at least 0.003, or at least 0.005, or at least 0.008, or at least 0.01, or at least 0.03, or at least 0.05, or at least 0.08, or at least 0.1, or at least 0.2, or at least 0.3, or at least 0.4, or at least 0.5, or at least 0.6, or at least 0.7, or at least 0.8, or at least 0.9. The ratio ($T_C/T_{BM}$) can be a value between any of the maximum and minimum values noted above, such as within a range including not greater than 0.99 to at least 0.001, or not greater than 0.5 to at least 0.005, or not greater than 0.2 to at least 0.01.

It will be appreciated that the abrasive article of the present disclosure may have any suitable size and shape as known in the art.

Figure 6:
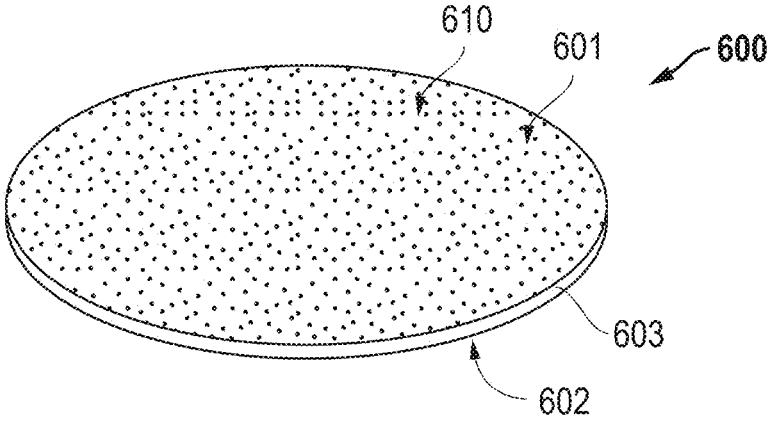
FIG. 6 includes an illustration of an abrasive article according to one embodiment.

In one embodiment, as illustrated in FIG. 6A, an abrasive article of the present disclosure can have a first surface (601), a second surface (602), and a side surface (603) extending between the first surface and the second surface. The first surface (601) of the substrate can be planar and the abrasive particles may be coupled to the first surface (601) by the bond material. The abrasive article can be subjected to vapor deposition to form a parylene coating on the exterior first surface of the abrasive article.

Figure 7:
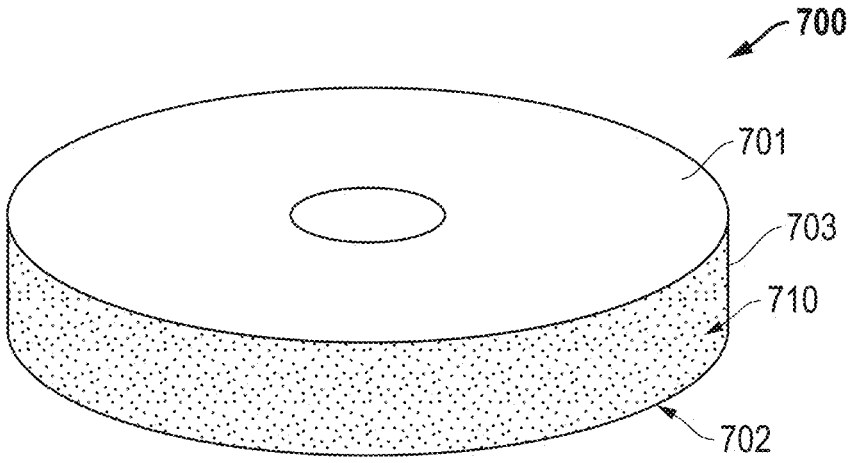
FIG. 7 includes an illustration of an abrasive article according to one embodiment.

In another embodiment, as illustrated in FIG. 7, an abrasive article can have a first surface (601), a second surface (602), and a side surface (603) extending between the first surface and the second surface. The side surface (603) can be a curved surface and the abrasive particles may be coupled to the side surface (603) by the bond material. The abrasive article can be subjected to vapor deposition to form a parylene coating on the exterior side surface of the abrasive article.

Figure 9:
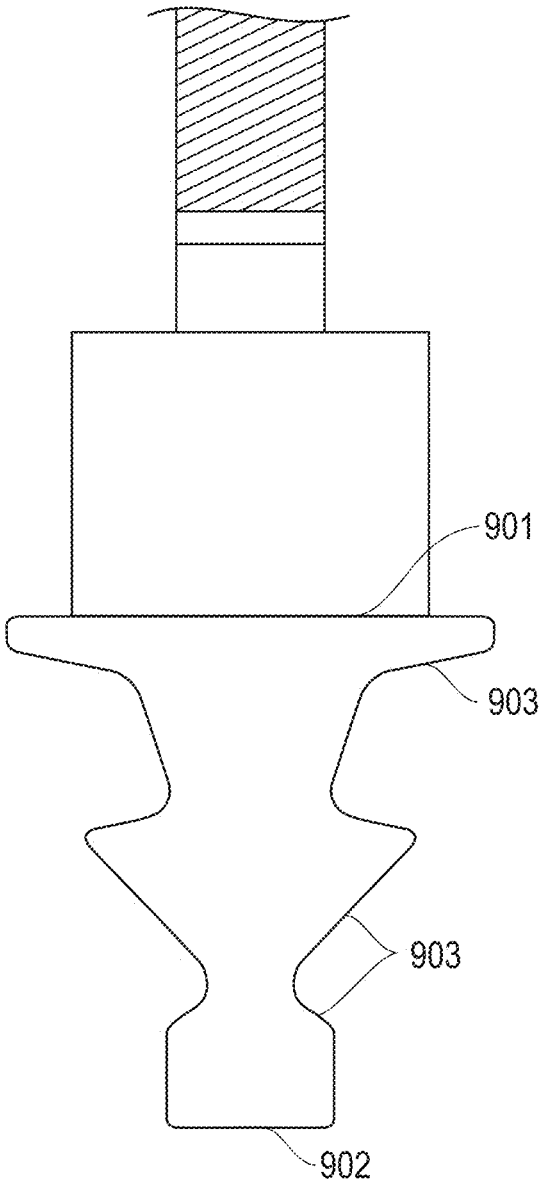
FIG. 9 includes an illustration of an abrasive article according to one embodiment.

In yet a further embodiment, the abrasive article of the present disclosure can be a complex shaped tool based on a substrate having a complex shape. As used herein, a complex shaped substrate can have surfaces with a non-monotonic curvature, more specifically a combination of different curvatures, such as a combination of convex and concave curvatures. For example, as illustrated in FIG. 9, the abrasive article can be a mounted point quill SA tool with complex shape, wherein the substrate can have a first surface (901), a second surface (902), and a complex shaped side surface (903). A single layer of abrasive particles can be coupled to the curved side surface (903) of the substrate by the bond material. The abrasive article can be subjected to vapor deposition to form a parylene coating on the exterior side surface (903).

Figure 11:
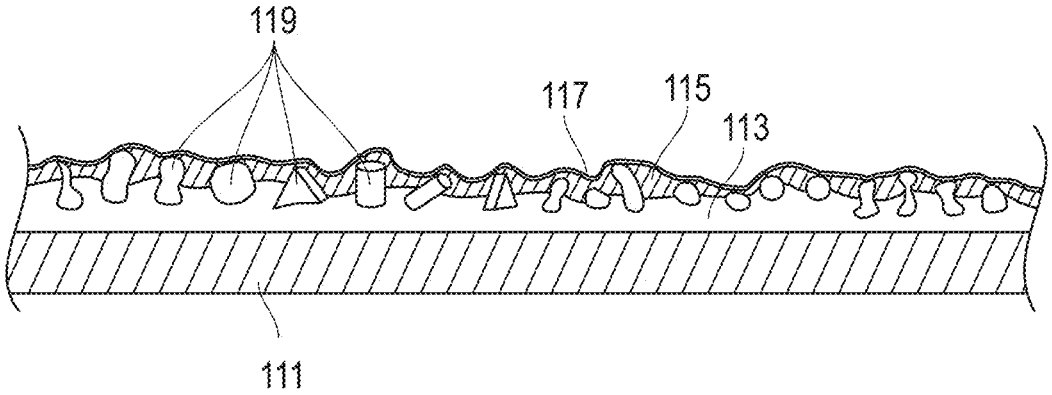
FIG. 11 includes an illustration of a fraction of a cross-cut of an abrasive article according to one embodiment.

An illustration of an abrasive article wherein the bond material is a plurality of films for attaching a single layer of abrasive particles to a substrate (also called backing herein), can be seen in FIG. 11. The article illustrated in FIG. 11 comprises a backing 111, on which a first binder layer 113, also called "make coat," is applied. A single layer of abrasive particles 119 can be partially embedded in the make coat and thereby fixed to the backing. On top of the make coat 113 and the abrasive particles 119 can be further applied a second binder layer 115, typically called a "size coat," which can provide a more secure attachment of the abrasive particles to the make coat and the backing. In a particularly preferred aspect, a parylene coating 117 is deposited directly on top of the size coat 115.

The backing 111 of the abrasive article shown in FIG. 11 can be flexible or rigid. The backing 111 can be made of any number of various materials including those conventionally used as backings in the manufacture of coated abrasives. An exemplary flexible backing can include a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a treated version thereof. Cloth backings can be woven or stitch bonded. In particular examples, the backing can be selected from the group consisting of paper, polymer film, cloth (e.g., cotton, poly-cotton, rayon, polyester, poly-nylon), vulcanized rubber, vulcanized fiber, metal foil, metal fiber, and any combination thereof. In other examples, the backing includes polypropylene film or polyethylene terephthalate (PET) film.

The material of the make coat 113 and the size coat 115 can be the same or different. In a certain embodiment, the make coat and the size coat can comprise organic polymeric materials, for example, a phenolic resin, an epoxy resin, a polyester, a polyurethane, or a combination of polymer types. The make coat 113 and/or the size coat 115 can further contain non-polymeric additives commonly known in the art and as described above.

In a further aspect, a third binder layer in form of a supersize coat (not shown in FIG. 12), can overly the size coat 115, and be between size coat 115 and the parylene coating 117 of the present disclosure. The supersize coat can be the same as or different from the binder composition used to form the size coat and/or the make coat.

In certain particular embodiments, the parylene coatings shown in FIGS. 1-8, and 11 can be parylene HT coatings.

The coating of the body of the present disclosure can provide a good protection of the bond material against corrosion and mechanical destruction, and may thereby enhance the life time of an abrasive article.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1

An abrasive article comprising: a substrate; abrasive particles coupled to the substrate by a bond material; and a coating overlying at least a portion of the least one bond material, wherein the coating comprises a poly(p-xylylene) polymer or a poly(p-xylylene) copolymer.

Embodiment 2

The abrasive article of embodiment 1, wherein the substrate comprises an elongated member having an aspect ratio of length:width of at least about 10:1.

Embodiment 3

The abrasive article of embodiment 1, wherein the substrate comprises an average length of at least about 50 m.

Embodiment 4

The abrasive article of embodiment 1, wherein the substrate comprises a wire.

Embodiment 5

The abrasive article of embodiment 1, wherein the substrate comprises a plurality of filaments braided together.

Embodiment 6

The abrasive article of embodiment 1, wherein the substrate comprises a first surface, second surface, and a side surface extending between the first surface and second surface.

Embodiment 7

The abrasive article of embodiment 6, wherein the first surface is a planar surface and the abrasive particles are coupled to the first surface by the bond material.

Embodiment 8

The abrasive article of embodiment 6, wherein the side surface is a curved surface and the abrasive particles are coupled to the side surface by the bond material.

Embodiment 9

The abrasive article of embodiment 1, wherein the substrate comprises an organic or inorganic material.

Embodiment 10

The abrasive article of embodiment 1, wherein the substrate comprises a material selected from the group consisting of a metal, metal alloy, polymer, woven material, nonwoven material, a fibrous material, paper, or any combination thereof.

Embodiment 11

The abrasive article of embodiment 1, wherein the substrate comprises a material selected from the group consisting of polyester, polyurethane, polypropylene, polyimide or any combination thereof.

Embodiment 12

The abrasive article of embodiment 1, wherein the substrate comprises a material selected from the group consisting of copper, aluminum, steel, or any combination thereof.

Embodiment 13

The abrasive article of embodiment 1, wherein the substrate includes a backing comprising one or more additives selected from the group of catalysts, coupling agents, curants, anti-static agents, suspending agents, anti-loading agents, lubricants, wetting agents, dyes, fillers, viscosity modifiers, dispersants, defoamers, and grinding agents.

Embodiment 14

The abrasive article of embodiment 1, wherein the bond material comprises a material selected from the group consisting of an organic material, an inorganic material, or any combination thereof.

Embodiment 15

The abrasive article of embodiment 1, wherein the bond material comprises a material selected from the group consisting of a metal, a metal alloy, a ceramic, a cermet, a glass, a composite, or any combination thereof.

Embodiment 16

The abrasive article of embodiment 1, wherein the bond material comprises a material selected form the group consisting of a polyester, an epoxy resin, a polyurethane, a polyamide, a polyacrylate, a polymethacrylate, a polyvinyl chloride, a polyethylene, a polysiloxane, a silicone, a cellulose acetate, a nitrocellulose, a natural rubber, starch, shellac, or any combination thereof.

Embodiment 17

The abrasive article of embodiment 1, wherein the bond material comprises a transition metal element.

Embodiment 18

The abrasive article of embodiment 1, wherein the bond material comprises an alloy including at least one transition metal element.

Embodiment 19

The abrasive article of embodiment 1, wherein the bond material comprises a metal selected from the group of metals consisting of nickel, lead, silver, copper, zinc, tin, titanium, molybdenum, chromium, iron, manganese, cobalt, niobium, tantalum, tungsten, palladium, platinum, gold, ruthenium, or any combination thereof.

Embodiment 20

The abrasive article of embodiments 1 or 19, wherein the bond material comprises nickel.

Embodiment 21

The abrasive article of embodiments 1, 18, or 19, wherein the bond material consists essentially of nickel.

Embodiment 22

The abrasive article of embodiment 1, wherein the bond material comprises a braze.

Embodiment 23

The abrasive article of embodiment 1, wherein the bond material comprises a solder having a melting point of not greater than about 450° C. and at least 100° C.

Embodiment 24

The abrasive article of embodiment 1, wherein the bond material is in the form of a layer of material.

Embodiment 25

The abrasive article of embodiments 1 or 24, wherein the bond material is in the form of a discontinuous layer having bond regions separated by gap regions, wherein gap regions define portions of a surface of the substrate free of the bond material.

Embodiment 26

The abrasive article of embodiments 1 or 24, wherein the bond material is in the form of a continuous layer of material extending over at least a portion of a surface of the substrate.

Embodiment 27

The abrasive article of embodiments 1 or 24, wherein the bond material defines a continuous layer having a substantially uniform thickness.

Embodiment 28

The abrasive article of embodiment 1, wherein the bond material comprises at least one of a braze, an electroplated material, an electroless plated material, a solder, or any combination thereof.

Embodiment 29

The abrasive article of embodiment 1, wherein the bond material comprises a curable material.

Embodiment 30

The abrasive article of embodiment 1, wherein the bond material comprises a plurality of layers, including a first layer and a second layer overlying the first layer.

Embodiment 31

The abrasive article of embodiment 1, wherein the substrate is flexible and comprises a substrate coating.

Embodiment 32

The abrasive article of embodiments 1 or 30, wherein the substrate comprises a non-woven material.

Embodiment 33

The abrasive article of embodiments 1 or 30, wherein the substrate comprises a woven material.

Embodiment 34

A fixed diamond wire including the abrasive article of embodiment 1.

Embodiment 35

A metal single layer abrasive article including the abrasive article of embodiment 1.

Embodiment 36

The abrasive article of embodiment 1, wherein the abrasive particles are arranged in a single layer overlying the substrate.

Embodiment 37

The abrasive article of embodiment 1, wherein the bond material is free of porosity.

Embodiment 38

The abrasive article of embodiment 1, wherein the abrasive particles have an average particle size (D50) greater than an average thickness of the bond material.

Embodiment 39

The abrasive article of embodiment 1, wherein the abrasive particles have an average particle size (D50) and the bond material comprises an average thickness ($T_{BM}$), and further comprising a bond material thickness to particle size ratio ($T_{BM}$/D50) of not greater than 1, or not greater than 0.9, or not greater than 0.8, or not greater than 0.7, or not greater than 0.6, or not greater than 0.5, or not greater than 0.4, or not greater than 0.3, or not greater than 0.2, or not greater than 0.1.

Embodiment 40

The abrasive article of embodiment 1, wherein the abrasive particles have an average particle size (D50) and the bond material comprises an average thickness ($T_{BM}$), and further comprising a bond material thickness to particle size ratio ($T_{BM}$/D50) of at least 0.1 or at least 0.2 or at least 0.3 or at least 0.4 or at least 0.5 or at least 0.6 or at least 0.7 or at least 0.8 or at least 0.9.

Embodiment 41

The abrasive article of embodiment 1, wherein the poly (p-xylylene) polymer or the poly(p-xylylene) copolymer include fluorine, chlorine, bromine, or any combination thereof.

Embodiment 42

The abrasive article of embodiment 1, wherein the poly (p-xylylene) or the poly(p-xylylene) copolymer include an alkyl group or an alkoxy group.

Embodiment 43

The abrasive article of embodiment 1, wherein the poly (p-xylylene) polymer or the poly(p-xylylene) copolymer is a linear polymer or a cross-linked polymer.

Embodiment 44

The abrasive article of embodiment 1, wherein the coating comprises parylene N, parylene C, parylene D, parylene HT, or any combination thereof.

Embodiment 45

The abrasive article of embodiment 1, wherein the coating consists essentially of parylene N, parylene C, parylene D, parylene HT, or any combination thereof.

Embodiment 46

The abrasive article of embodiment 1, wherein the coating comprises parylene including fluorine.

Embodiment 47

The abrasive article of embodiment 1, wherein the coating is preferentially disposed on the bond material.

Embodiment 48

The abrasive article of embodiment 47, wherein the coating is in direct contact with the bond material.

Embodiment 49

The abrasive article of embodiment 1, wherein the coating is in direct contact with the bond material and a majority of the exterior surfaces of the abrasive particles extending above the bond material are free of the coating.

Embodiment 50

The abrasive article of embodiment 1, wherein the coating is in direct contact with a surface of the bond material and a surface of the abrasive particles.

Embodiment 51

The abrasive article of embodiment 1, wherein the coating preferentially overlies the abrasive particles.

Embodiment 52

The abrasive article of embodiment 1, wherein the coating is in direct contact with the abrasive particles and a majority of an exterior surface of the bond material is free of the coating.

Embodiment 53

The abrasive article of embodiment 1, wherein the coating is a conformal coating extending over the abrasive particles and bond material.

Embodiment 54

The abrasive article of embodiment 1, wherein the coating defines an exterior surface of the abrasive article.

Embodiment 55

The abrasive article of embodiment 1, wherein the abrasive particles have an average particle size (D50) and the coating comprises an average thickness (TO, and further comprising a coating thickness to particle size ratio ($T_C$/D50) of not greater than 1, or not greater than 0.9, or not greater than 0.8, or not greater than 0.7, or not greater than 0.6, or not greater than 0.5, or not greater than 0.4, or not greater than 0.3, or not greater than 0.2, or not greater than 0.1, or not greater than 0.08, or not greater than 0.05, or not greater than 0.03.

Embodiment 56

The abrasive article of embodiment 1, wherein the abrasive particles have an average particle size (D50) and the coating comprises an average thickness (TO, and further comprising a coating thickness to particle size ratio ($T_C$/D50) of at least 0.001, or at least 0.003, or at least 0.005, or at least 0.008, or at least 0.01, or at least 0.03, or at least 0.05, or at least 0.08, or at least 0.1, or at least 0.2, or at least 0.3, or at least 0.4, or at least 0.5, or at least 0.6, or at least 0.7, or at least 0.8, or at least 0.9.

Embodiment 57

The abrasive article of embodiment 1, wherein the bond material comprises an average thickness ($T_{BM}$), the coating comprises an average thickness (TO, and further comprising a coating thickness to bond material thickness ratio ($T_C$/$T_{BM}$) of not greater than 1 or not greater than 0.9 or not greater than 0.8 or not greater than 0.7 or not greater than 0.6 or not greater than 0.5 or not greater than 0.4 or not greater than 0.3 or not greater than 0.2 or not greater than 0.1 or not greater than 0.08 or not greater than 0.05 or not greater than 0.03.

Embodiment 58

The abrasive article of embodiment 1, wherein the bond material comprises an average thickness ($T_{BM}$), the coating comprises an average thickness (TO, and further comprising a coating thickness to bond material thickness ratio ($T_C$/

$T_{BM}$) of at least 0.001, or at least 0.003, or at least 0.005, or at least 0.008, or at least 0.01, or at least 0.03, or at least 0.05, or at least 0.08, or at least 0.1, or at least 0.2, or at least 0.3, or at least 0.4, or at least 0.5, or at least 0.6, or at least 0.7, or at least 0.8, or at least 0.9.

Embodiment 59

The abrasive article of embodiment 1, wherein the coating comprises an average thickness of at least 0.1 microns, or at least 0.3 microns, or at least 0.5 microns, or at least 1 micron, or at least 2 microns, or at least 3 microns, or at least 5 microns, or at least 10 microns.

Embodiment 60

The abrasive article of embodiment 1, wherein the coating comprises an average thickness of not greater than 500 microns or not greater than 300 microns, or not greater than 200 microns, or not greater than 100 microns, or not greater than 75 microns, or not greater than 50 microns, or not greater than 25 microns, or not greater than 10 microns, or not greater than 5 microns.

Embodiment 61

The abrasive article of embodiment 1, wherein the abrasive particles comprise a material selected from the group of materials consisting of oxides, carbides, nitrides, borides, oxynitrides, oxyborides, diamond, or any combination thereof.

Embodiment 62

The abrasive article of embodiment 1, wherein the abrasive particles comprise a superabrasive material, wherein the abrasive particles comprise diamond or cubic boron nitride, wherein the abrasive particles consist essentially of diamond, wherein the abrasive particles comprise a material having a Vickers hardness of at least about 10 GPa.

Embodiment 63

The abrasive article of embodiment 1, wherein the abrasive particles include a first type of abrasive particle and a second type of abrasive particle, and wherein the first type of abrasive particle and second type of abrasive particle are different from each other based on at least one particle characteristics selected from the group consisting of hardness, friability, toughness, particle shape, crystalline structure, average particle size, composition, particle coating, grit size distribution, or any combination thereof.

Embodiment 64

The abrasive article of embodiment 1, wherein the abrasive particles comprise an average particle size of not greater than about 5000 microns, or not greater than about 3000 microns, or not greater than about 2000 microns, or not greater than about 1500 microns, or not greater than about 300 microns.

Embodiment 65

The abrasive article of embodiment 1, wherein the abrasive particles comprise an average particle size of at least about 0.1 microns, or at least about 0.5 microns, or at least about 1 micron, or at least about 2 microns, or at least about 5 microns, or at least about 8 microns.

Embodiment 66

The abrasive article of embodiment 1, wherein the coating has a melting point of at least 350° C., or at least 380° C., or at least 400° C., or at least 420° C., or at least 440° C., or at least, 460° C., or at least 480° C., or at least 500° C.

Embodiment 67

The abrasive article of embodiment 1, wherein the coating has a melting point of not greater than 600° C., such as not greater than 580° C., not greater than 550° C.; not greater than 530° C., not greater than 510° C., not greater than 500° C., or not greater than not 460° C., or not greater than 420° C.

Embodiment 68

The abrasive article of embodiment 1, wherein the substrate comprises woven or non-woven fibers; the bond material comprises a first layer and a second layer, wherein the first layer of the bond material directly overlies the substrate and attaches a single layer of abrasive particles to the substrate; and the second layer of the bond material overlies the first layer of the bond material and the abrasive particles; and wherein the coating overlies an outer surface of the second bond layer.

Embodiment 69

A method of forming an abrasive article, comprising: providing a substrate having abrasive particles coupled to a surface of the substrate by a bod material; applying a coating by vapor deposition, wherein the coating overlies the bond material and abrasive particles, wherein the coating comprises a poly(p-xylylene) polymer.

Embodiment 70

The method of embodiment 69, wherein the poly(p-xylylene) polymer includes parylene HT.

Embodiment 71

The method of embodiment 69, wherein the coating has an average thickness of at least 0.5 microns and not greater than 25 microns.

EXAMPLES

Example 1

Investigating the grinding performance of parylene HT coated fiber disc

A single layer abrasive fiber disc of the type F970 SH from Saint-Gobain—was coated with a thin parylene HT coating by vapor deposition. The F970 SH disc underneath the parylene HT coating contained a fiber backing as substrate material having attached via a make coat a layer of ceramic particles with a 36 grit size. The F970 SH disc further contained a size coat on top of the make coat and abrasive particles for fixing the abrasive particles.

The parylene HT vapor deposition process included vaporization of the dimer compound 1, 1, 2, 2, 9, 9, 10, 10-octafluoro [2.2] paracyclophane, pyrolysis of the dimer to the monomer, and forming the parylene HT polymer during deposition. The vacuum during deposition in the deposition chamber was 0.1 Torr, at a temperature of 25° C.

The applied parylene HT coating had an average thickness of about 5 to 7 microns. The parylene HT coated disc is called herein sample S1.

As comparative sample C2 was used the same type of disc F970SH as described for sample S1 above; the only difference to S1 was that it did not contain a parylene HT coating.

A further comparative fiber disc C3 was used for the grinding testing, which is also called a 36 grit control, wherein a layer of 36 grit size ceramic particles was attached by a standard make coat and a standard size coat, and which also did not contain a parylene coating.

Figure 10:
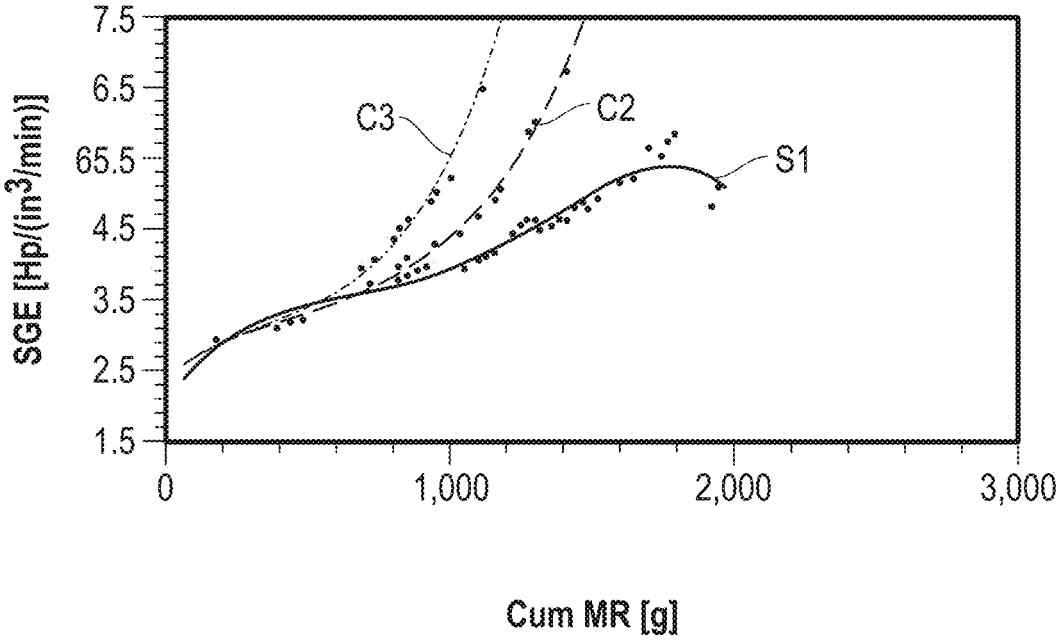
FIG. 10 includes a graph illustrating the grinding performance of a single-layer abrasive disc containing a parylene HT coating according to one embodiment, and comparing the grinding performance with two comparative single layer discs.

The grinding tests were conducted by measuring the specific grinding energy SGE (energy/unit volume) vs. the cumulative material removal of a test material. The test material was an A36 hot rolled steel piece. As illustrated in FIG. 10, the parylene HT coated disc (S1) significantly outperformed the disc C2 which did not contain a parylene HT coating. Comparative standard control disc C3 had the lowest material removal in relation to the SGE. It can be further seen that the addition of the parylene coating required a much lower specific grinding energy (SGE) and allowed a much longer grinding operation and thereby higher cumulative material removal.

The foregoing embodiments are directed to bonded abrasive products, and particularly grinding wheels, which represent a departure from the state-of-the-art.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Reference herein to a material including one or more components may be interpreted to include at least one embodiment wherein the material consists essentially of the one or more components identified. The term "consisting essentially" will be interpreted to include a composition including those materials identified and excluding all other materials except in minority contents (e.g., impurity contents), which do not significantly alter the properties of the material. Additionally, or in the alternative, in certain non-limiting embodiments, any of the compositions identified herein may be essentially free of materials that are not expressly disclosed. The embodiments herein include range of contents for certain components within a material, and it will be appreciated that the contents of the components within a given material total 100%.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive article comprising:

a substrate;

abrasive particles coupled to the substrate by a bond material; and a coating overlying at least a portion of the bond material, wherein the coating comprises a fluorinated poly(p-xylylene) polymer, wherein the substrate comprises a wire.

2. The abrasive article of claim 1, wherein the substrate comprises a material selected from the group consisting of a metal or a metal alloy.

3. The abrasive article of claim 1, wherein the bond material comprises a material selected from an organic material, an inorganic material, or a combination thereof.

4. The abrasive article of claim 3, wherein the bond material comprises a material selected from the group of a metal, a metal alloy, a ceramic, a cermet, a glass, a composite, or any combination thereof.

5. The abrasive article of claim 3, wherein the bond material comprises a material including a polyester, an epoxy resin, a polyurethane, a polyamide, a polyacrylate, a polymethacrylate, a polyvinyl chloride, a polyethylene, a polysiloxane, a silicone, a cellulose acetate, a nitrocellulose, a natural rubber, starch, shellac, or any combination thereof.

6. The abrasive article of claim 1, wherein the bond material comprises a plurality of layers, including a first layer and a second layer overlying the first layer.

7. The abrasive article of claim 1, wherein the abrasive particles are arranged in a single layer overlying the substrate.

8. The abrasive article of claim 1, wherein the abrasive particles have an average particle size (D50) greater than an average thickness of the bond material.

9. The abrasive article of claim 1, wherein the coating consists essentially of parylene HT.

10. The abrasive article of claim 1, wherein the coating is in direct contact with a surface of the bond material and a surface of the abrasive particles.

11. The abrasive article of claim 1, wherein the coating comprises an average thickness of at least 0.5 microns and not greater than 25 microns.

12. The abrasive article of claim 1, wherein the abrasive particles comprise a material selected from the group of oxides, carbides, nitrides, borides, oxynitrides, oxyborides, diamond, or any combination thereof.

13. The abrasive article of claim 1, wherein the coating has a melting point of at least 350° C. and not greater than 600° C.

14. A method of forming an abrasive article, comprising:

providing a substrate having abrasive particles coupled to a surface of the substrate by a bond material, wherein the substrate comprises a wire;

applying a coating by vapor deposition, wherein the coating overlies the bond material and abrasive particles, wherein the coating comprises a fluorinated poly(p-xylylene) polymer.

15. The method of claim 14, wherein the fluorinated poly(p-xylylene) polymer includes parylene HT.

16. The method of claim 14, wherein the coating has an average thickness of at least 0.5 microns and not greater than 25 microns.

17. The abrasive article of claim 1, wherein the substrate comprises a metal or metal alloy and the abrasive particles comprise diamond.

18. The abrasive article of claim 17, wherein a ratio $T_c$/D50 of an average thickness of the coating (Tc) to an average particle size of the abrasive particles (D50) is between 0.1 and 0.9.

19. The abrasive article of claim 17, wherein the bond material includes a metal selected from nickel, copper, tin, or any combination thereof.

20. The abrasive article of claim 18, wherein the bond material includes a first layer and second layer overlying the first layer, and the bond material comprises nickel.

* * * * *